US008535067B2

(12) United States Patent
Yu et al.

(10) Patent No.: US 8,535,067 B2
(45) Date of Patent: Sep. 17, 2013

(54) POWER CONNECTOR WITH IMPROVED SPACER AND IMPROVED HOUSING FOR SECURING CONTACTS THEREOF

(75) Inventors: Wang-I Yu, Jhonghe (TW); Kuo-Cheng Liu, Jhonghe (TW)

(73) Assignee: Alltop Electronics (Suzhou) Ltd., Taicang (CN)

( * ) Notice: Subject to any disclaimer, the term of this patent is extended or adjusted under 35 U.S.C. 154(b) by 0 days.

(21) Appl. No.: 13/325,926

(22) Filed: Dec. 14, 2011

(65) Prior Publication Data

US 2013/0095684 A1 Apr. 18, 2013

(30) Foreign Application Priority Data

Oct. 13, 2011 (CN) ..... 2011 1 0309842

(51) Int. Cl.
*H01R 12/00* (2006.01)

(52) U.S. Cl.
USPC ..... 439/79; 439/65

(58) Field of Classification Search
USPC ..... 439/65, 79, 101, 108, 485, 692, 682, 439/825, 947
See application file for complete search history.

(56) References Cited

U.S. PATENT DOCUMENTS

| | | | | |
|---|---|---|---|---|
| 6,394,818 | B1 * | 5/2002 | Smalley, Jr. | 439/79 |
| 6,805,591 | B2 * | 10/2004 | Garland et al. | 439/733.1 |
| 6,821,161 | B1 * | 11/2004 | Cao | 439/701 |
| 6,835,103 | B2 * | 12/2004 | Middlehurst et al. | 439/699.1 |
| 7,303,401 | B2 * | 12/2007 | Schell et al. | 439/65 |
| 7,997,936 | B2 * | 8/2011 | Yu | 439/651 |
| 8,096,814 | B2 * | 1/2012 | Schell et al. | 439/79 |

* cited by examiner

*Primary Examiner* — Thanh Tam Le
(74) *Attorney, Agent, or Firm* — Sughrue Mion, PLLC

(57) ABSTRACT

A power connector mounting on a printed circuit board (PCB), includes an insulating housing, a number of power contacts received in the housing and a pair of spacers attached to the insulating housing. The insulating housing extends along a transversal direction and defines a number of passageways extending therethrough along a front-to-back direction. The insulating housing has a front wall, an opposite rear wall, a pair of side walls and a bottom wall with the passageway extending through the front wall and the rear wall. The spacer is assembled to the pairs of power contacts with locking members thereon for holding the power contacts in positions with respect to the insulating housing.

13 Claims, 8 Drawing Sheets

POWER CONNECTOR WITH IMPROVED SPACER AND IMPROVED HOUSING FOR SECURING CONTACTS THEREOF

BACKGROUND OF THE INVENTION

1. Field of the Invention

The present invention relates to an electrical connector, and more particularly to a power connector mounting on a printed circuit board (PCB).

2. Description of Related Art

Nowdays, there are many ways to assembly a plurality of contacts into an insulating housing. In some typical connectors, the contacts are physically attached to the insulating housing. Or, the contacts are inserted molded within the insulating housing. When the contacts are assembled to the insulating housing by mechanical manner, interference-fit way is usually employed. However, the contacts, which are interference-fitted in the insulating housing, are easily displaced from those original positions and corresponding electronic performance will be damaged.

Hence, a power connector with improved structure to secure the contacts in original positions is needed.

BRIEF SUMMARY OF THE INVENTION

The present invention provides a power connector mounting on a printed circuit board (PCB), comprises an insulating housing, a plurality of power contacts received in the housing and a pair of spacers attached to the insulating housing. The insulating housing extends along a transversal direction and defines a plurality of passageways extending therethrough along a front-to-back direction. The insulating housing has a front wall, an opposite rear wall, a pair of side walls and a bottom wall with the passageway extending through the front wall and the rear wall. The spacer is assembled to the pairs of power contacts with locking members thereon for holding the power contacts in positions with respect to the insulating housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
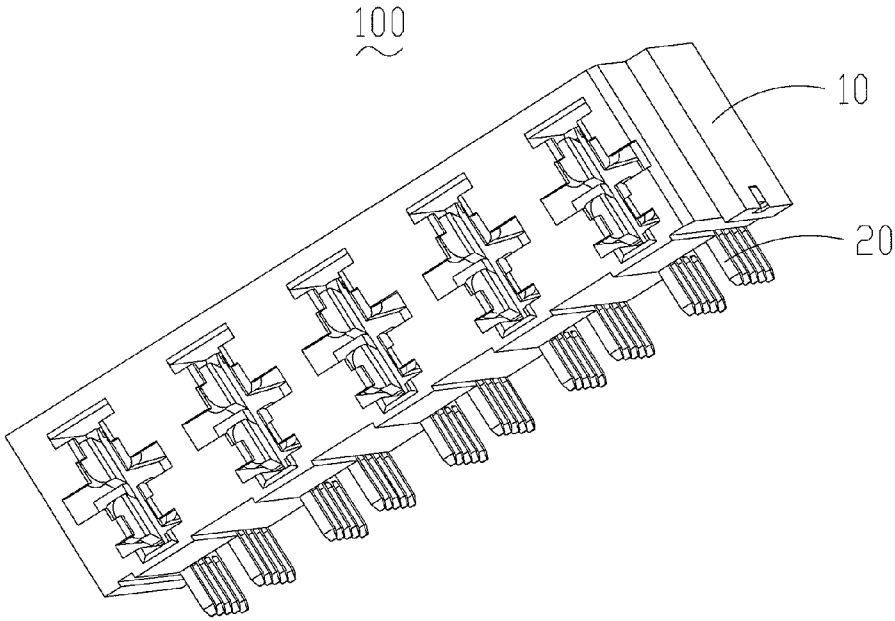
FIG. 1 is a perspective view of a power connector in accordance with the present invention.

Reference will now be made to the drawing figures to describe the embodiments of the present invention in detail. In the following description, the same drawing reference numerals are used for the same elements in different drawings.

Referring to FIGS. 1-4, a power connector 100, which is mounting onto a printed circuit board (PCB, not shown), in accordance with the present invention comprises an insulating housing 10 extending along a transversal direction, a plurality of pairs of power contacts 20 assembled to the insulating housing 10, and a pair of spacers 30 secure the pairs of power contacts 20 on the insulating housing 10.

The insulating housing 10 includes a front wall 12, a top wall 13, a bottom wall 14, a pair of side walls 15 and a rear wall 17 opposite to the front wall 12. The front wall 12 provides a mating face 11 for mating with a complementary connector (not shown) and the rear wall 17 provides a rear face 18 opposite to the mating face 11. In the preferred embodiment, one of the pair of side walls 15 defines a depression 151 thereof for anti-misplug purposes.

Figure 2:
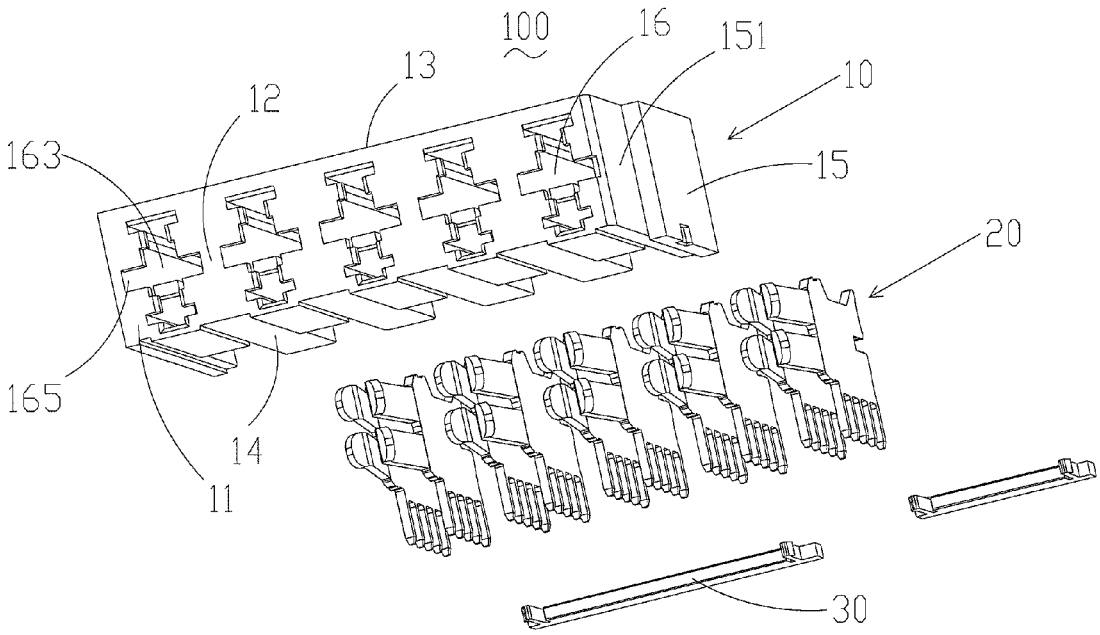
FIG. 2 is an exploded, perspective view of the power connector assembly shown in FIG. 1.
Figure 5:
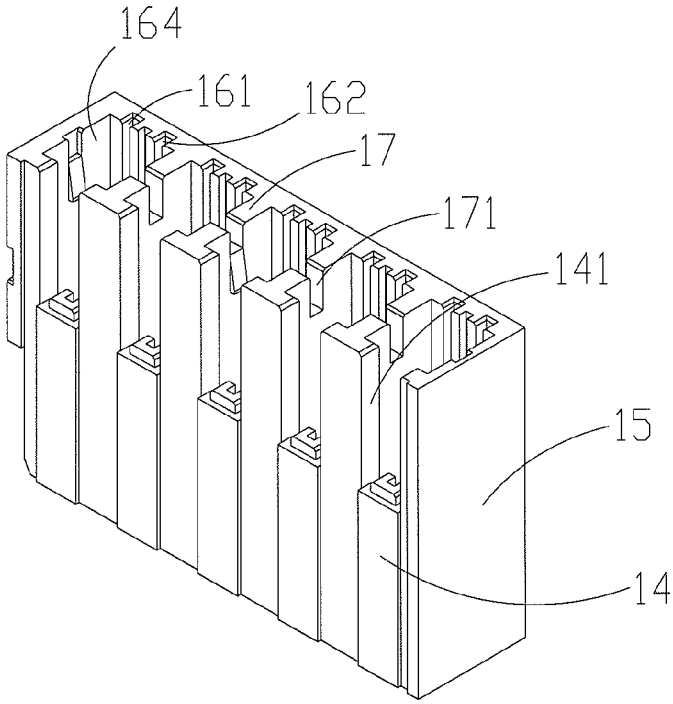
FIG. 5 is a perspective view of an insulating housing of the power connector.
Figure 6:
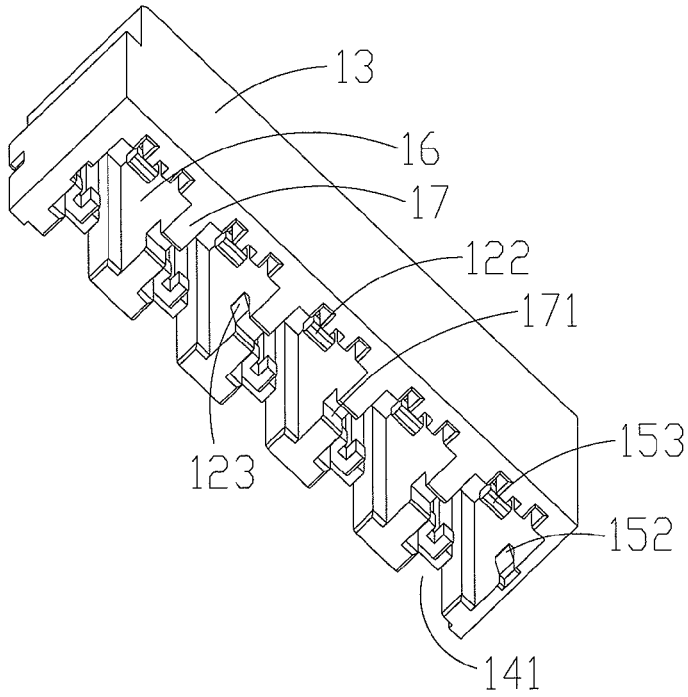
FIG. 6 is another perspective view of the insulating housing.

Referring to FIG. 2 together with FIGS. 5 and 6, the insulating housing 10 defines a plurality of passageways 16 extending from the mating face 11 to the rear face 18. Each passageway 16 includes a first passageway 161 and a second passageway 162 parallel to and communicating with the first passageway 161. The first and the second passageways 161, 162 are formed for receiving corresponding power contacts 20. Details will be given hereinafter. The passageway 16 comprises a front opening 163 opened from the mating face 11 of the front wall 12 and a rear opening 164 opened from the rear face 18 of the rear wall 17. The front opening 163 has a different shape from that of the rear opening 164. The passageway 16 comprises a pair of opposite cutouts 165 in the mating face 11 which are communicating with the front opening 163. There are a plurality of channels 141 defined in the bottom wall 14 of the insulating housing 10. The channels 141 extend partially inwards into the bottom wall 14 from a rear edge thereof and are opened from the rear wall 17. The channel 141 communicates with the rear opening 164 of the corresponding passageway 16. In the selected passageways 16, a plurality of protrusions 123, 152 are formed in inside faces of the selected passageways, which will be engageable with the spacers 30. Details will be given hereinafter. Each passageway 16 also provides a pair of stoppers 153 in opposite inside faces thereof. A plurality of positioning grooves 171 are defined in the rear wall 17.

Figure 7:
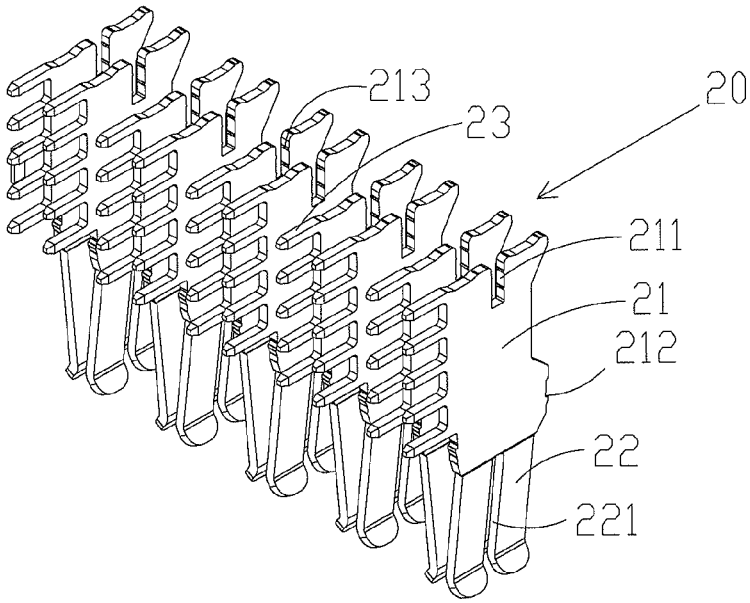
FIG. 7 is a perspective view of power contacts of the power connector.

As shown in FIG. 7, each power contact 20 includes a flat main portion 21, a contacting portion 22 and a tail portion 23 extending from opposite sides of the flat main portion 21. The contacting portion 22 has a pair of contacting fingers with a groove 221 defined therebetween. The groove 221 is engaged with the stopper 153 for preventing a front-to-back movement of the power contact 20. The tail portion 23 comprises a plurality of distal tails extending vertically to the contacting fingers 22. Each power contact 20 defines a positioning slot 213 recessed from a rear edge of the main portion 21 thereof. The positioning slot 213 extends along a front-to-back direction and is positioned in a same line of the positioning grooves 171 of the insulating housing 10. The power contact 20 also forms a plurality of barbs 212 on a top edge of the main portion 21 for inteference-fitting in the passageway 16.

Figure 3:
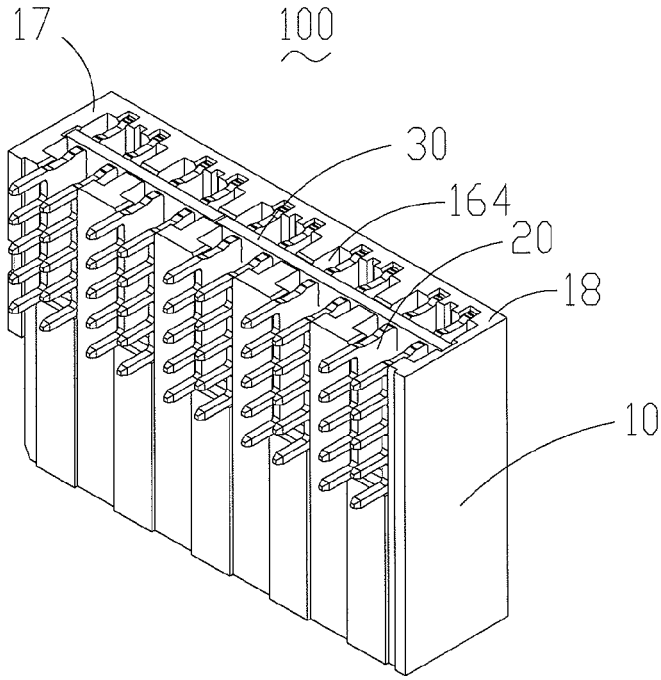
FIG. 3 is another perspective view of the power connector.
Figure 4:
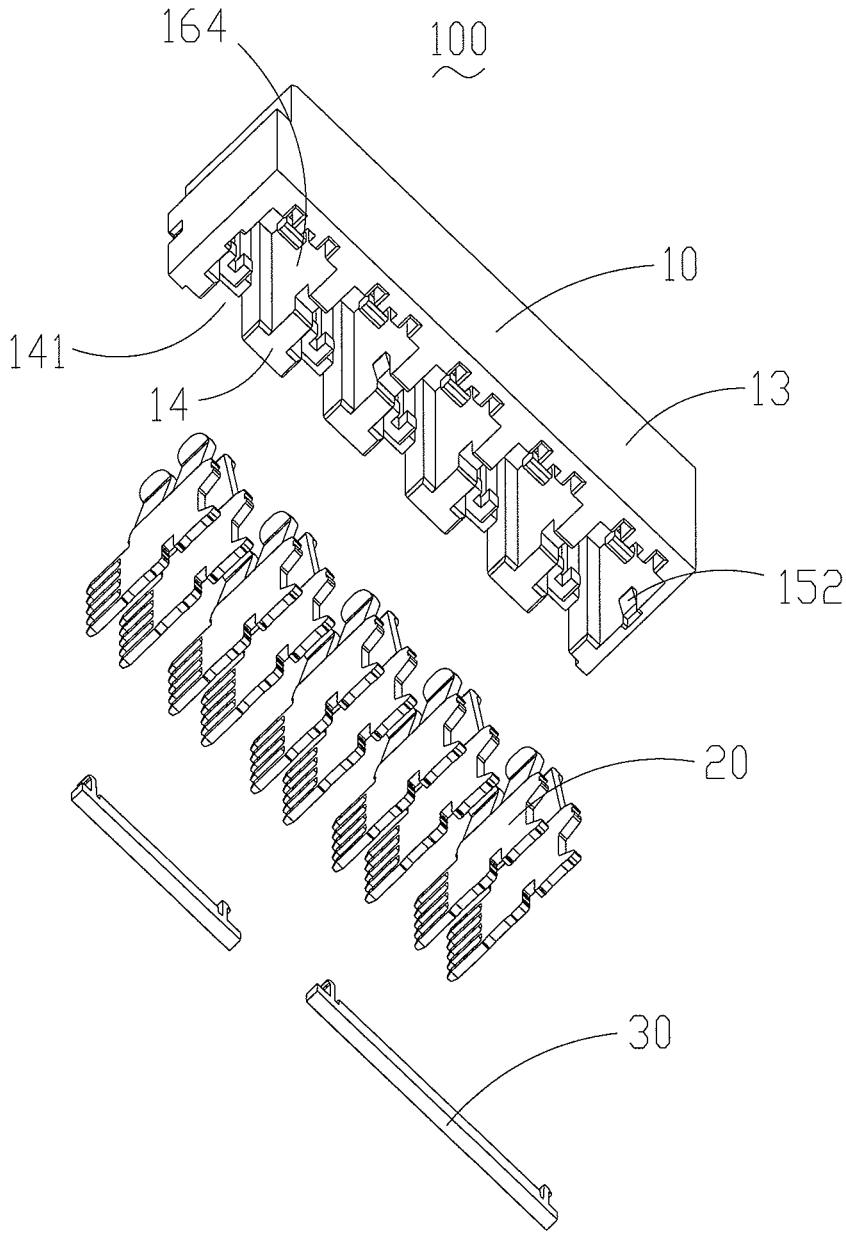
FIG. 4 is another exploded, perspective view of the power connector.
Figure 8:
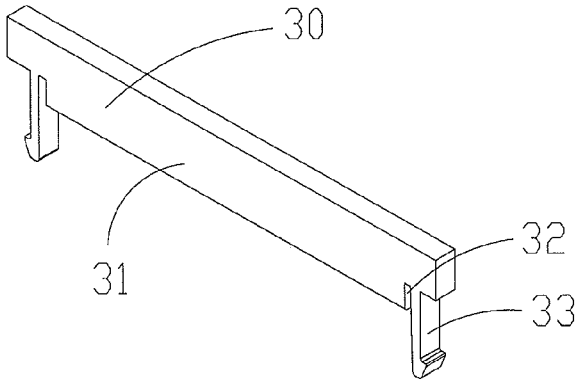
FIG. 8 is a perspective view of the spacer of the power connector.

Together referring to FIGS. 2-3 and 8, the spacer 30 comprises an elongated main portion 31 and a pair of locking members 33 extending vertically from the main portion 31. In the preferred embodiment, the locking members 33 of the spacer 30 are a pair of locking claws. The spacer 30 defines a slit 32 between the main portion 31 and the pair of locking claws 33 for providing the locking claws with resilience. The main portion 31 of the spacer 30 is inserted and received in the positioning slots 211 of the power contacts 20 and the positioning grooves 171 of the insulating housing 10. The locking claws 33 engage with corresponding protrusions 123, 152 of the selected passageways 16. Therefore, the spacer 30 secures the power contacts with respect to the insulating housing 10. The spacer 30 has a surface coplanar with a surface of the rear wall 17 when the spacer 30 is assembled on the insulating housing 10 from a rear side thereof. As can be understood, the number of spacers 30 can be various according to different application environment.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A power connector mounting on a printed circuit board (PCB), comprising:

an insulating housing extending along a transversal direction and defining a plurality of passageways extending therethrough along a front-to-back direction, said insulating housing having a front wall, an opposite rear wall, a pair of side walls and a bottom wall, said plurality of passageways opened from said front wall and said rear wall, respectively; and a plurality of pairs of flat power contacts received in corresponding passageways; and at least one spacer assembled to said pairs of power contacts with locking members thereon for holding said pairs of power contacts in positions with respect to said insulating housing, said spacer having a surface coplanar with a surface of said rear wall;

wherein each power contact defines a positioning slot inwardly recessed from a rear side edge thereof;

wherein said rear wall defines at least one positioning groove communicating with said positioning slots of said power contacts and wherein said spacer is engaged within said at least one positioning groove and said positioning slots.

2. The power connector as claimed in claim 1, wherein the each power contact forms a flat main portion, a contacting portion and a tail portion extending oppositely from said flat main portion, said positioning slot being defined in said flat main portion.

3. The power connector as claimed in claim 2, wherein said contacting portion is provided with a pair of contacting fingers with a groove defined therebetween.

4. The power connector as claimed in claim 3, wherein said tail portion is provided with a plurality of distal ends extending vertically to said contacting portion.

5. The power connector as claimed in claim 1, wherein said insulating housing is provided with locking portions in inside faces of selected passageways and wherein said locking portions cooperate with said locking member of said spacer to thereby secure the spacer on said insulating housing.

6. The power connector as claimed in claim 5, wherein said locking member of said spacer has a pair of locking claws and wherein said locking portions of said insulating housing are formed as protrusions engaging with said locking claws.

7. The power connector as claimed in claim 6, wherein said insulating housing defines a depression on one of side walls, said depression extending from said top wall to said bottom wall.

8. The power connector as claimed in claim 6, wherein said bottom wall of said insulating housing is provided with a plurality of channels partially extending inwards thereinto and being opened to said rear wall, and wherein said plurality of channels communicates with corresponding passageways for said tail portion of said power contacts extending therethrough.

9. The power connector as claimed in claim 3, wherein said insulating housing has a mating face in said front wall and wherein said plurality of passageways each defines a front opening opened in the front wall.

10. The power connector as claimed in claim 9, wherein said opening of said each passageway defines a pair of opposite cutouts communicating with said groove of corresponding power contact.

11. The power connector as claimed in claim 2, wherein each of said passageway comprises a first passageway and a second passageway parallel to said first passageway, said first and said second passageways being defined for receiving corresponding main portions of said pair of power contacts.

12. The power connector as claimed in claim 3, wherein each of said passageway defines a pair of opposite stoppers projecting from opposite inside faces, each stopper engaging with said groove of said contacting fingers of said power contact for limiting a front-to-back movement thereof.

13. A power connector, comprising:

an insulating housing extending along a transversal direction, said insulating housing comprising a mating face and a rear face and defining a plurality of passageways extending from said mating face to said rear face;

pairs of power contacts received in corresponding passageways, each power contact defines a positioning slot in a rear side thereof; and at least one spacer assembled to said insulating housing, said spacer comprising an elongated main portion and a pair of locking members extending vertically from said elongated main portion, said main portion of said at least one spacer being engageable with said positioning slots of said power contacts to thereby secure the power contacts with respect to said insulating housing.

* * * * *